US006629360B2

(12) United States Patent
Ohuchi

(10) Patent No.: US 6,629,360 B2
(45) Date of Patent: Oct. 7, 2003

(54) CONTINUOUS RIVETER

(75) Inventor: Masatoshi Ohuchi, Koriyama (JP)

(73) Assignee: Opt Engineering Company Limited (JP)

( * ) Notice: Subject to any disclaimer, the term of this patent is extended or adjusted under 35 U.S.C. 154(b) by 63 days.

(21) Appl. No.: 09/880,360

(22) Filed: Jun. 13, 2001

(65) Prior Publication Data

US 2001/0054221 A1 Dec. 27, 2001

Related U.S. Application Data

(63) Continuation-in-part of application No. 09/293,761, filed on Apr. 15, 1999, now abandoned.

(30) Foreign Application Priority Data

Apr. 16, 1998 (JP) ..... 10-122795

(51) Int. Cl.[7] ..... B25C 1/04; B23Q 7/10

(52) U.S. Cl. ..... 29/812.5; 227/119; 227/136; 227/139

(58) Field of Search ..... 29/812.5; 227/135, 227/136, 139, 119

(56) References Cited

U.S. PATENT DOCUMENTS 5,273,200 A * 12/1993 Hoefler
5,452,796 A * 9/1995 Ohuchi et al.
5,544,407 A * 8/1996 Ohuchi et al.
6,499,642 B1 * 12/2002 Amada

* cited by examiner

*Primary Examiner*—Gregory Vidovich
*Assistant Examiner*—Eric Compton
(74) *Attorney, Agent, or Firm*—McGlew and Tuttle, P.C.

(57) ABSTRACT

A continuous riveter is provided, which can make a rivet distance in a blind rivet holder small since an available continuous riveter having a linear guide plate elongated from a rivet supply section could not reduce the rivet distance while avoiding the interference with a vertically movable cylinder. A guide plate (43) elongated from an accommodation case (40) of a rivet supply section C is provided with a bent section (43*b*) inclined at a predetermined angle α with respect to a linear feed section (43*a*). An axis of a cylinder (31) is disposed on a shank R1 of a blind rivet held by an upper tab T4 of a blind rivet holder T immediately after the rivet holder T has passed through the linear feed section (43*a*) and bent.

7 Claims, 14 Drawing Sheets

CONTINUOUS RIVETER

This is a continuation-in-part of patent application Ser. No. 09/293,761, filed on Apr. 15, 1999, now abandoned.

BACKGROUND OF THE INVENTION

1. Field of the Invention

The present invention relates to a continuous riveter for continuously ejecting blind rivets that effect the caulking on metal plates and so on (the blind rivet being hereafter referred to as a rivet).

2. Description of the Related Art

The typical continuous riveter includes one that is disclosed by Japanese Patent Application Laid-open No. Hei 7-236936 (Title of the Invention: "Riveter") and shown in FIGS. 8 to 13, and another prior thereto that is shown in FIG. 14.

FIGS. 8, 9 and 14 show a state where a shank R1 of the rivet R is held in a continuous riveter to insert a head R2 into a hole of a metal plate H, which is followed by "caulking".

Next, as shown in FIG. 10, a jaw case piston 20 is raised to move a jaw case 22 upwardly, whereby the pair of jaw 24 is biased to the lower part by springs via the jaw pusher 26. The jaw 24 glides to the lower part of the tapered surface 23 (refer to FIG. 13) of the jaw case 22, to thereby come close to each other and is raised upwardly by clamping the shank R1 of the rivet R (FIG. 9). Accordingly, the jaw 24 clamps the shank R1 and moves upwardly, so that "caulking" is conducted with the raise of the shank R1. Subsequently, the head R2 is held at the tip end of the nose piece 32 so the shank R1 is cut off from the head portion R2.

Next, as shown in FIG. 10, when a nose piston 30 is raised, a cylinder 31 is raised together with a nose piece 32. Accordingly, the shank R1 is moved upwardly away from the metal plate H. Then, as shown in FIG. 11, the shank R1 is vacuum-collected into a shank accommodating case 14 by a vacuum ejector 11, and the jaw case piston 20 and the nose piston 30 are moved up to their upper dead points. Therefore, the nose piece 32 is moved upwardly above a next shank R1.

At this time, as shown in FIG. 12, a feeding claw 46*a* which is connected to a feeding hole T6 of a blind rivet holder T, pulls out the blind rivet holder T, which has been moving forward by the piston 45 of the tape air cylinder 42, from the accommodation case 40 to move it for one shank, and sets the tip end of the shank R1 on top of the axis at the lower part of the nose piece 32 (refer to FIGS. 11 and 12).

As described above, after caulking one shank, the cylinder 31 is moved downwardly with the jaw case 32 to caulk the next shank R1.

The continuous riveter shown in FIG. 14 is designed such that the nose piece 32 is separated, but the structure of "caulking" is the same as that shown in FIGS. 8 to 13. The structure of "caulking" of the present invention is the same as that shown in FIGS. 8 to 13.

In the above, a distance between the rivets R is required to be set so as not to hinder the lowering movement of the cylinder 31.

FIG. 13 is an explanatory view, which is a side view of FIG. 12.

FIGS. 15 to 17 show a "blind rivet holder" which is registered as Japanese Utility Model Registration No. 3028739 by the present applicant before this application. This blind rivet holder is designed such that the rear portion of the riveter can be held upwardly to ease the rivet ejecting operation. Further, in order to increase the number of the rivets R held in an elongated plastic member T1 which forms the blind rivet holder T, the rivets R are supported by the upper and lower tabs T4 and T5 respectively not in an perpendicular direction with respect to the longitudinal direction of the elongated plastic member T1 but in an inclined direction. Even if the continuous riveters shown in FIGS. 8 to 13 and FIG. 14 are modified to use the blind rivet holder T, a rivet distance is required where the lowering movement of the cylinder 31 is not hindered as shown in FIGS. 15 to 17.

As described above, the conventional continuous riveters need to set the rivet R distance in the blind rivet holder T to be such rivet distance as to avoid hindering the lowering movement of the cylinder 31. Therefore, the riveters suffer from a problem in that the large number of rivets R can not be accommodated in the accommodation case 40.

SUMMARY OF THE INVENTION

The present invention has been made in view of the aforementioned problem. An object of the present invention is to provide a continuous riveter which can make the rivet distance in the blind rivet holder T small, thereby making it possible to accommodate the large number of the rivets R in the small accommodation case 40.

According to the present invention, there is provided a continuous riveter comprising:

- a chuck cylinder;
- a nose piston inserted to the chuck cylinder so as to be movable vertically, and provided at its lower end with an elongated cylinder;
- a jaw case piston with a jaw case inserted to the cylinder so as to be movable vertically;
- a jaw, internally inserted to a lower end of the jaw case and engageable and disengageable with and from a tapered surface on an internal lower end of the jaw case, for holding and releasing a shank of a blind rivet;
- a jaw pusher elastically biased to abut against a top of the jaw;
- a nose piston which is disposed at a lower end of the cylinder, and to which the shank of the blind rivet is to be inserted; and
- a rivet supply section including:
  - an accommodation case for accommodating therein a web-like blind rivet holder in a wound state which is mounted with a blind rivet; and
  - a tape air cylinder for guiding the blind rivet holder along a guide plate and supplying the blind rivet mounted on the blind rivet holder one by one, characterized in that:
    - the guide plate is elongated from the accommodation case of the rivet supply section, and includes a linear feed section of a predetermined length and a bent section inclined at a predetermined angle with respect to the linear feed section, whereby a perpendicular section of the blind rivet holder is bent along the bent section, after being passed through the linear feed section of a predetermined length;
    - a pressing plate is provided, for pressing and guiding the perpendicular section of the blind rivet holder, along the guide face from the linear feed section to the bent section of the guide plate, whereby the blind rivet holder sent out linearly by a feeding claw that reciprocatingly linearly moves by means of the tape air cylinder, is guided from the linear feed section to the bent section, and is then bent therealong due to the pressing plate; and the cylinder of the nose piston is positioned on the axis of the shank of the blind rivet in the upper and lower tab immediately after the blind rivet holder has passed the linear feed section of the guide plate and has been bent at the bent section, and is disposed so that the axis of the blind rivet corresponds to the cylinder axis.

DETAILED DESCRIPTION OF THE PREFERRED EMBODIMENT

Figure 1:
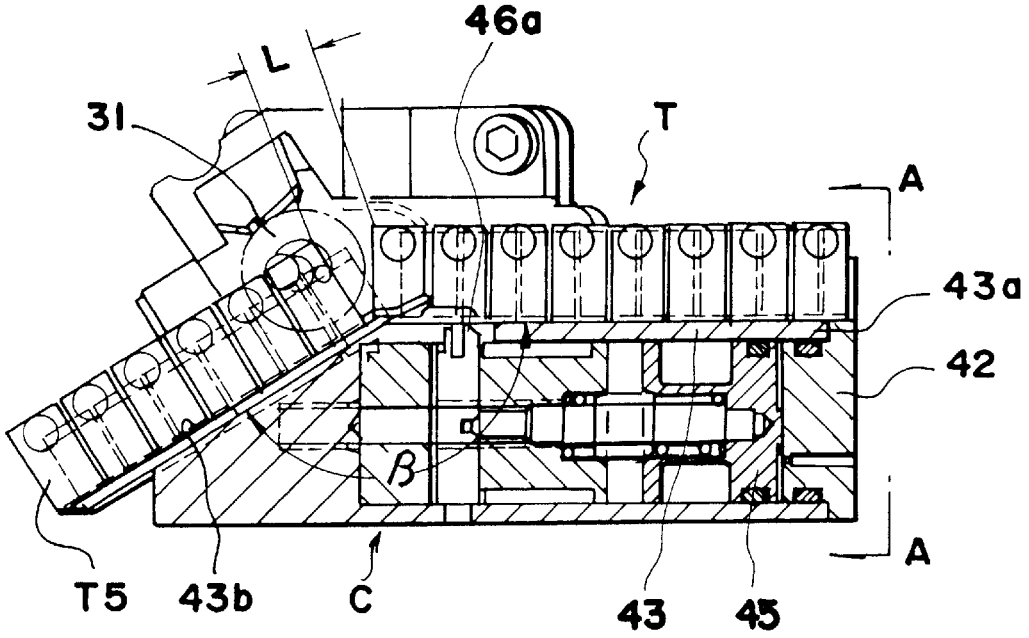
FIG. 1 is a bottom view showing an embodiment of the present invention.

A preferred embodiment of the present invention will be described in detail with reference to the drawing attached hereto.

Figure 2:
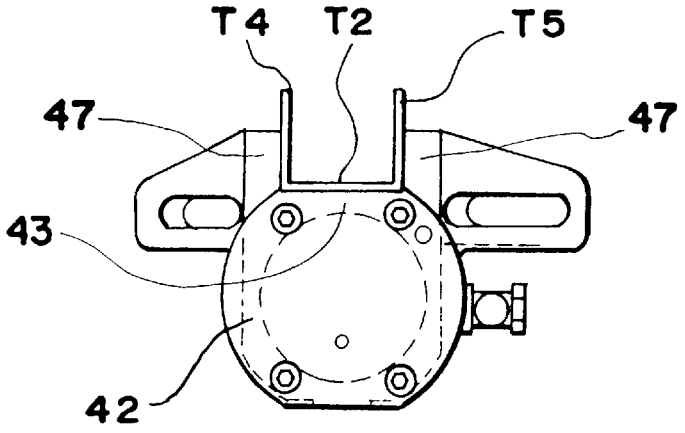
FIG. 2 shows the embodiment as viewed in the arrow A—A direction of FIG. 1.
Figure 3:
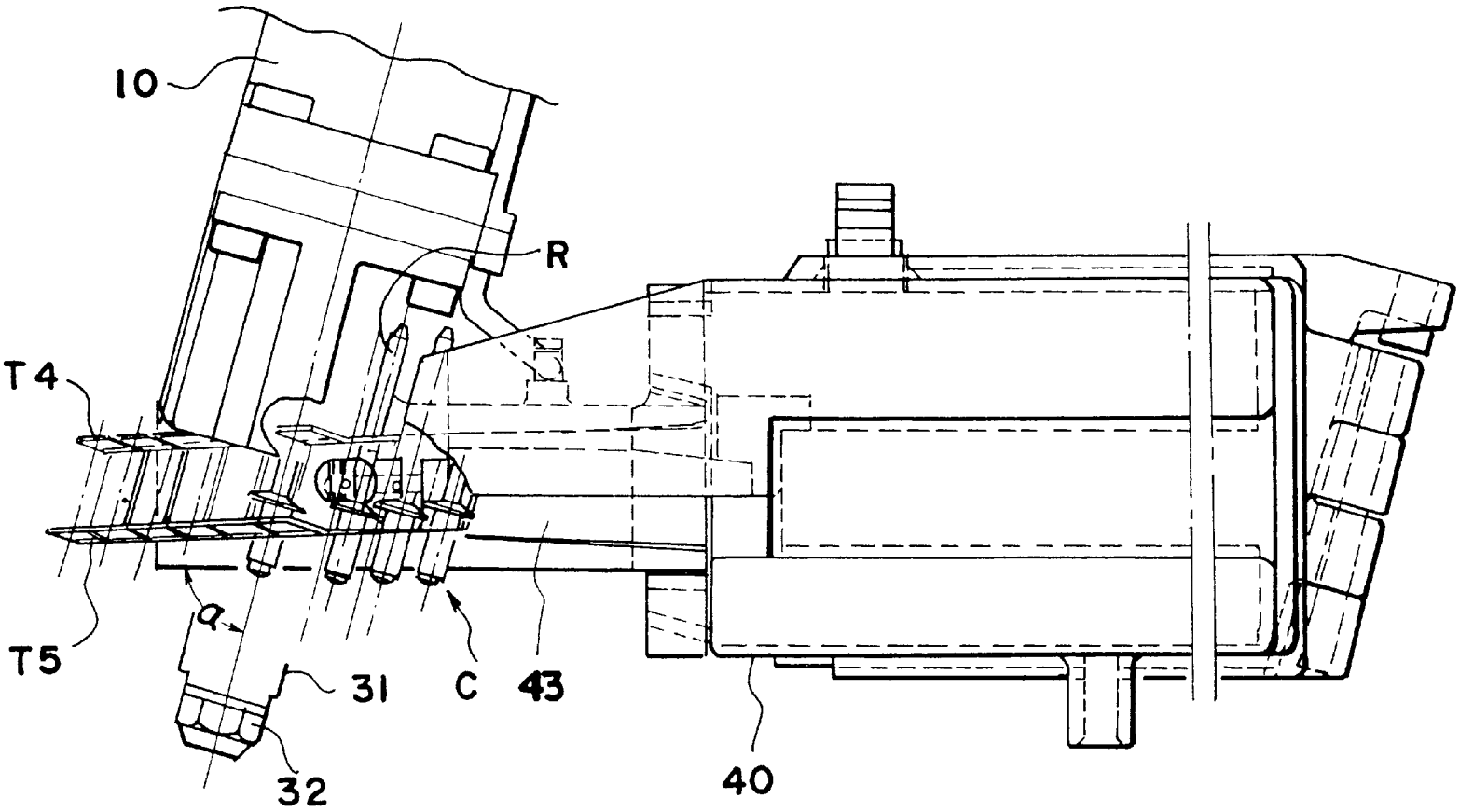
FIG. 3 is a side view of the embodiment of the present invention.
Figure 4:
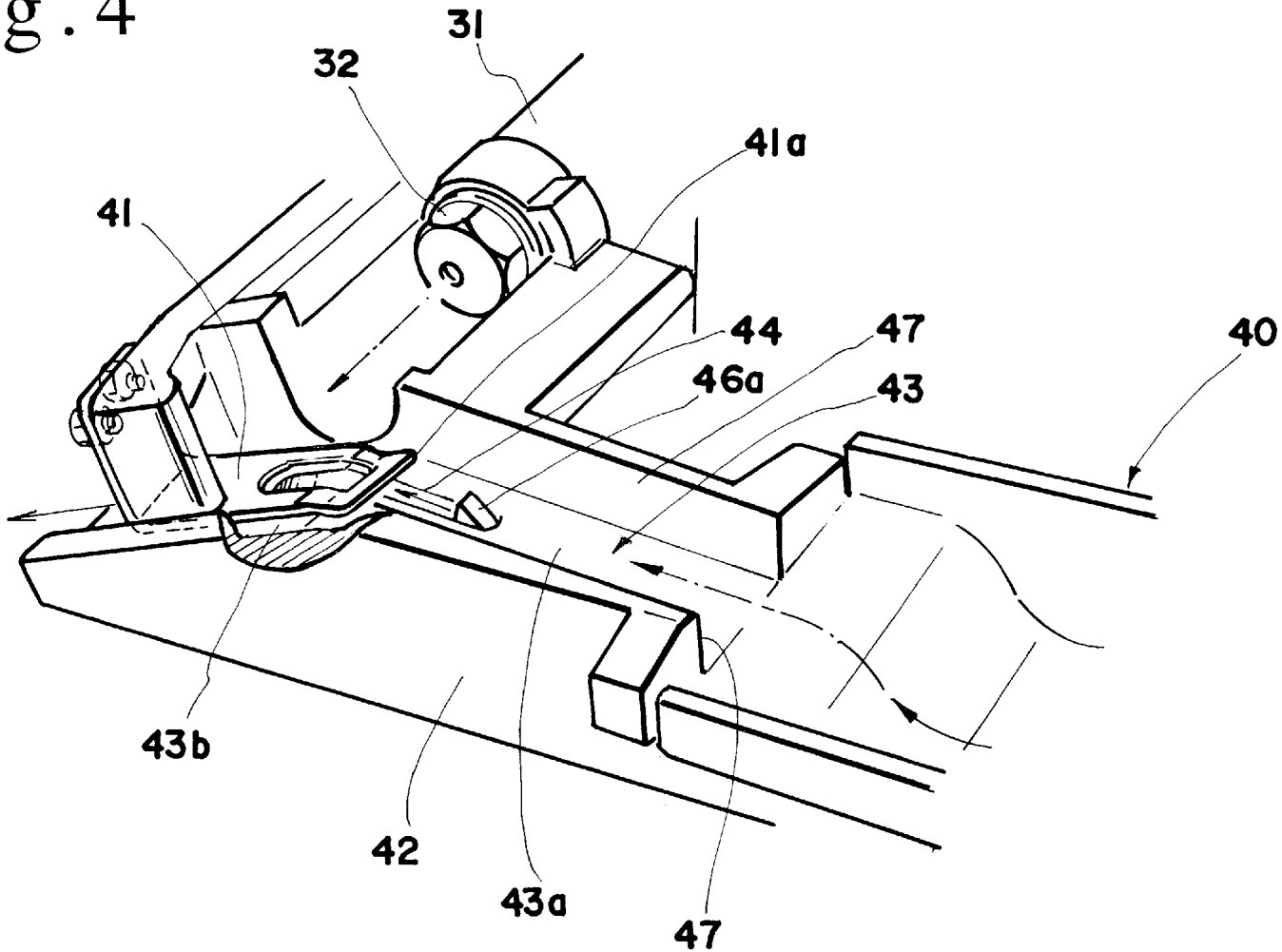
FIG. 4 is a perspective view showing a guide plate portion.

FIG. 1 is a bottom view of a continuous riveter according to the present invention, FIG. 2 shows the continuous riveter as viewed in the arrow A—A direction of FIG. 1, FIG. 3 is a side view of the continuous riveter, and FIG. 4 is a perspective view of the guide plate portion. The same components in FIGS. 8 to 17 are denoted with the same referential numerals.

As shown in FIG. 1, a guide plate 43 elongated from an accommodation case 40 of a rivet supply section C is provided with a bent section 43*b* which is bent in at a predetermined angle β with respect to the direction of a perpendicular section T2 of a blind rivet holder T through a linear feed section 43*a* of a predetermined length. The bent section 43*b* of the guide plate 43 is provided with a pressing plate 41 that presses and guides the perpendicular section T2 of the blind rivet holder T along the guide face from the linear feed section 43*a* to the bent section 43*b*. The end section 41*a* is a side where the blind rivet holder T of the pressing plate 41 enters, and is widened open in a taper form in the direction so that the blind rivet holder T can enter readily. With this pressing plate 41, the blind rivet holder T which is sent out linearly, will be surely guided and bent from the linear fees section 43*a* to the bent section 43*b*.

Figure 5:
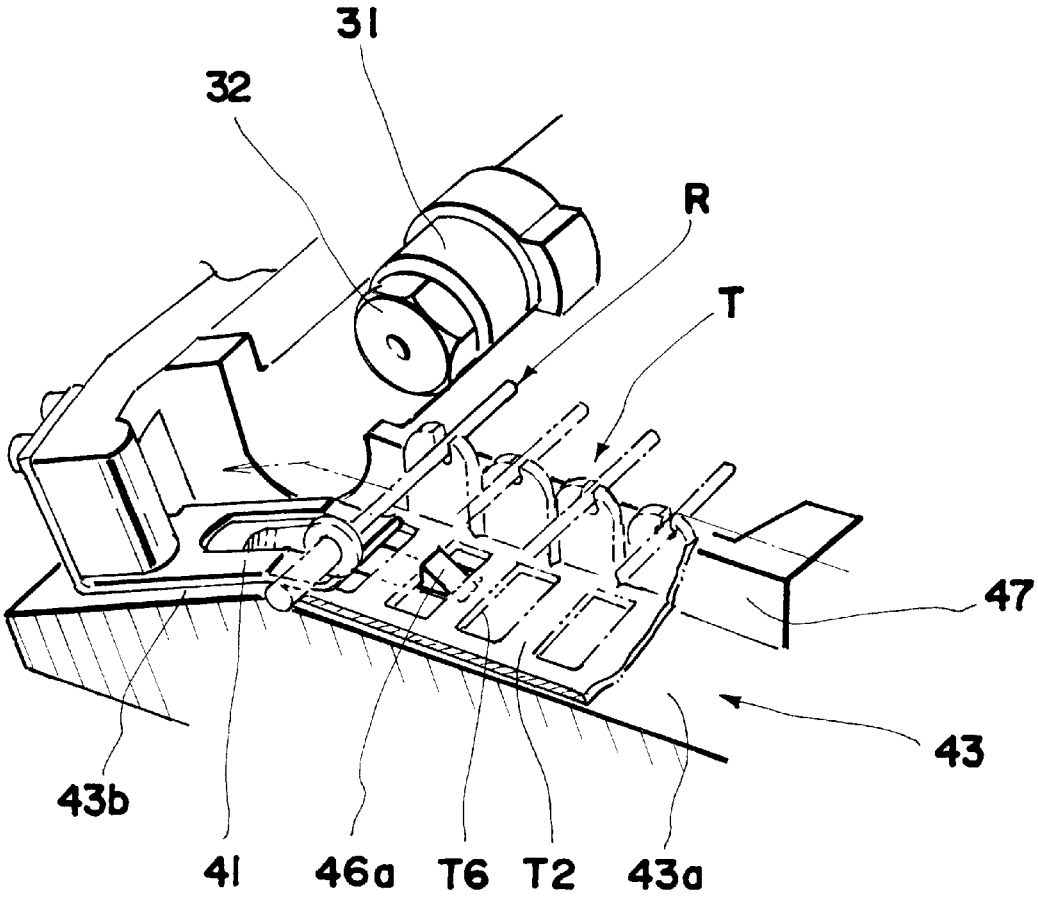
FIG. 5 is a perspective view showing a state of use of the guide plate portion.

The guide plate 43 is for guiding the blind rivet holder T and is provided with guide walls 47, 47 as shown in FIGS. 2 and 4. The blind rivet holder T is made to move without coming off the guide plate 43. Further, in the linear feed section 43*a* of the guide plate 43, there is a long hole 44 that linearly moves back and forth the feeding claw 46*a*, and by this long hole 44 the tip end of the feeding claw 46*a* is protruded. As shown in FIG. 1 (also refer to FIG. 12), the feeding claw 46*a* is connected to the piston 45 of the tape air cylinder 42, and by this tape air cylinder 42 it moves linearly back and forth. As shown in FIG. 5, a feeding claw 46*a* is connected to a feeding hole T6 of the blind rivet holder T, and sends out one blind rivet holder T by linearly forward movement of the feeding claw 46*a*.

Figure 6:
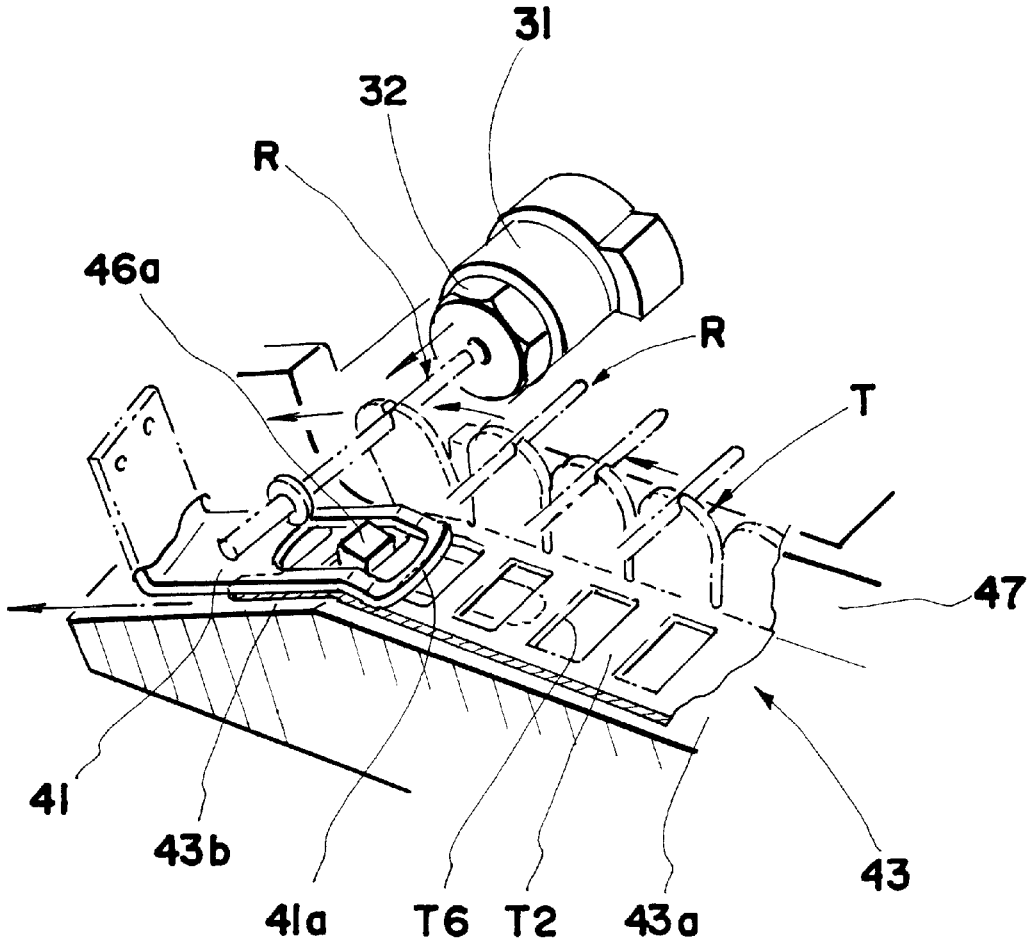
FIG. 6 is a perspective view showing the next state of use of the guide plate portion.
Figure 7:
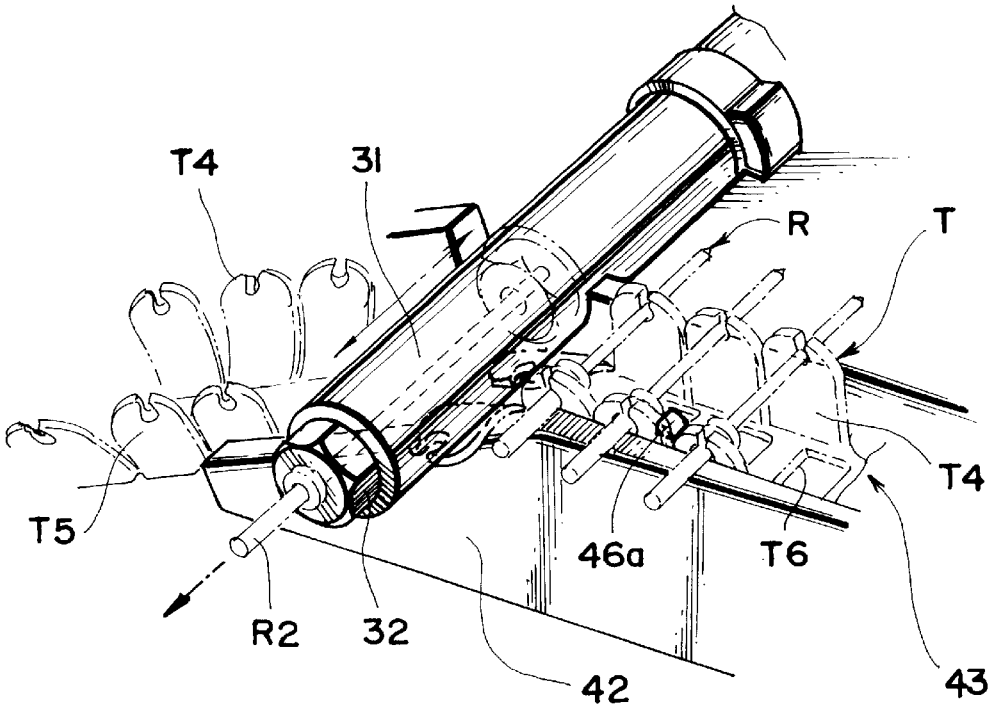
FIG. 7 is a perspective view further showing the next state of use of the guide plate portion.
Figure 8:
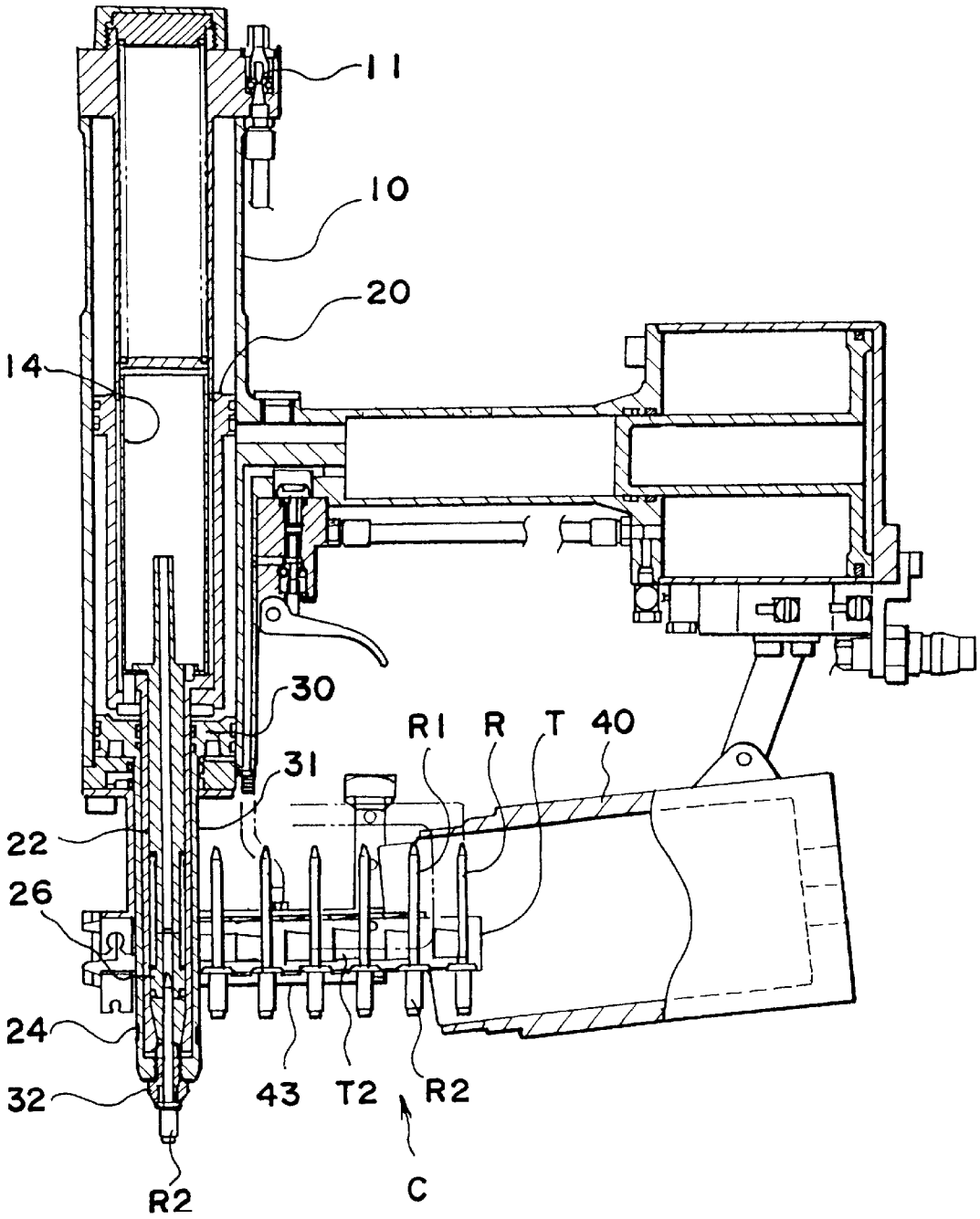
FIG. 8 is a sectional view of a conventional continuous riveter.
Figure 9:
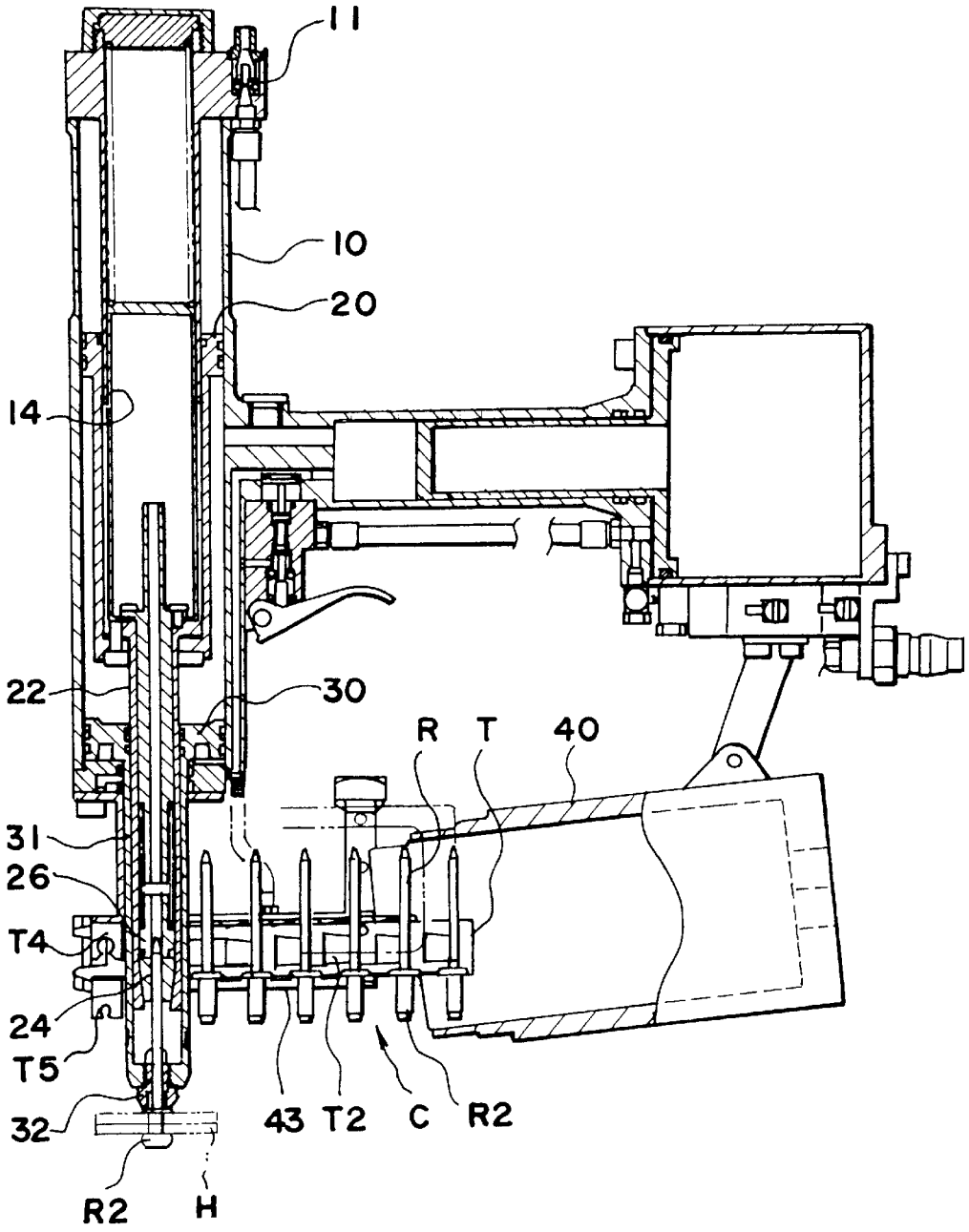
FIG. 9 is a sectional view of the conventional continuous riveter.
Figure 10:
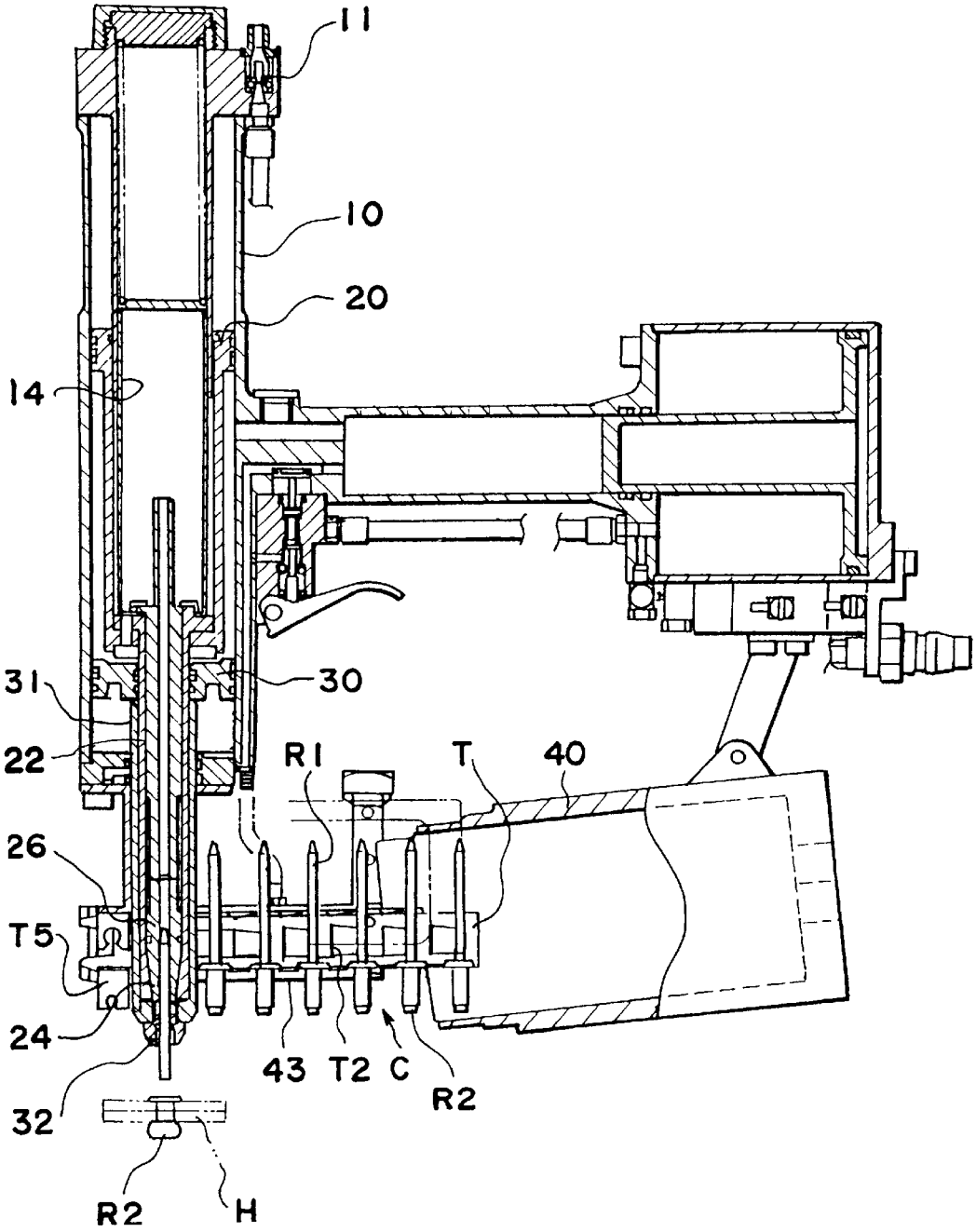
FIG. 10 is a sectional view of the conventional continuous riveter.
Figure 11:
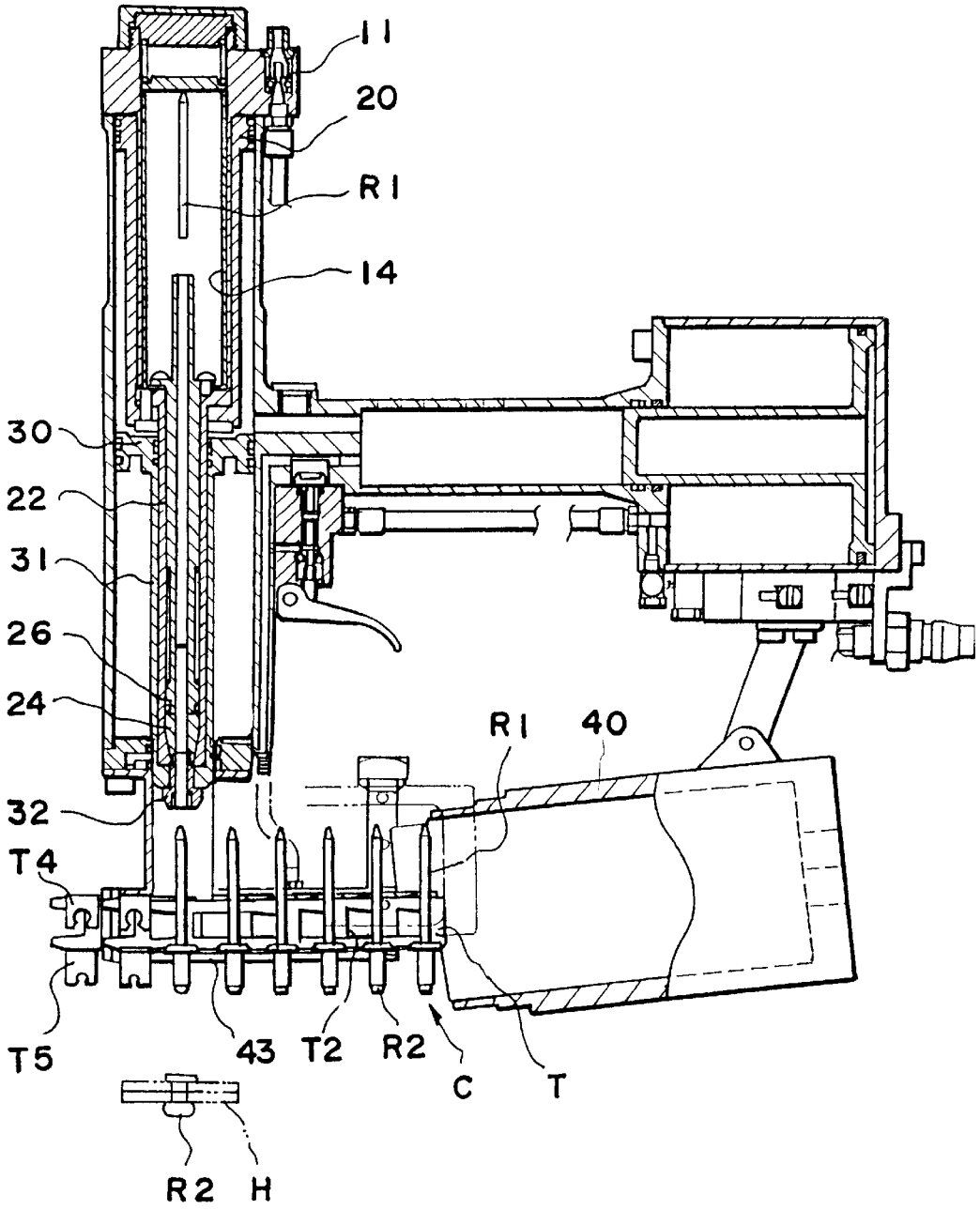
FIG. 11 is a sectional view of the conventional continuous riveter.
Figure 12:
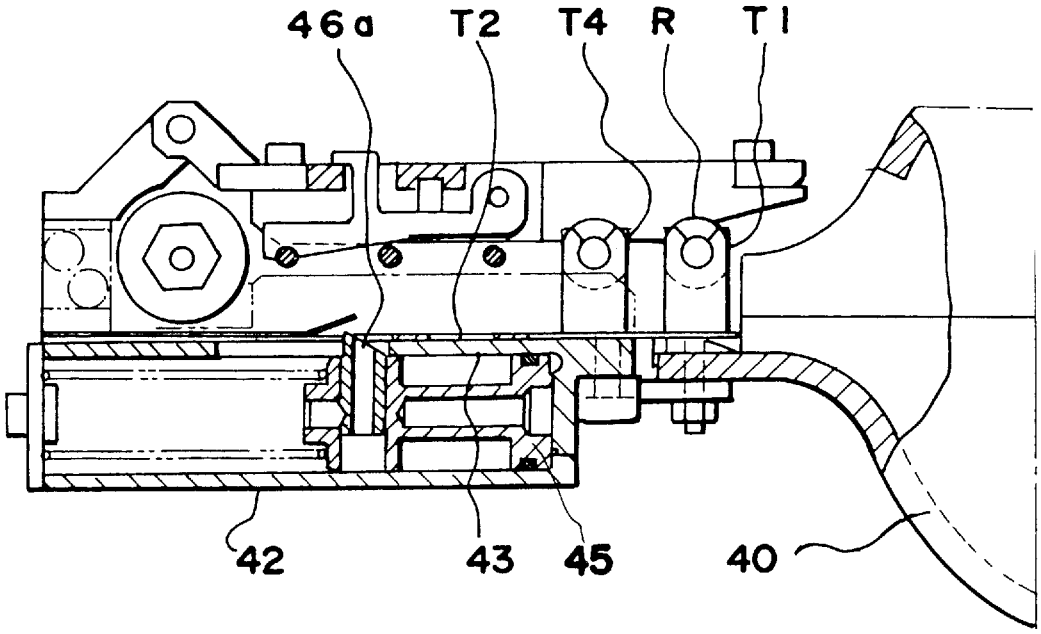
FIG. 12 is a laterally sectional view of a rivet supply section in the conventional continuous riveter.
Figure 13:
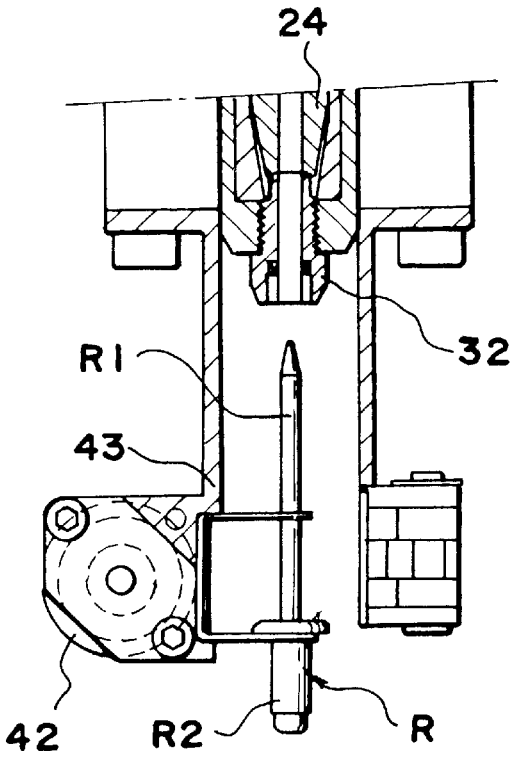
FIG. 13 is a longitudinally sectional view of a rivet supply section of a conventional continuous riveter.
Figure 15:
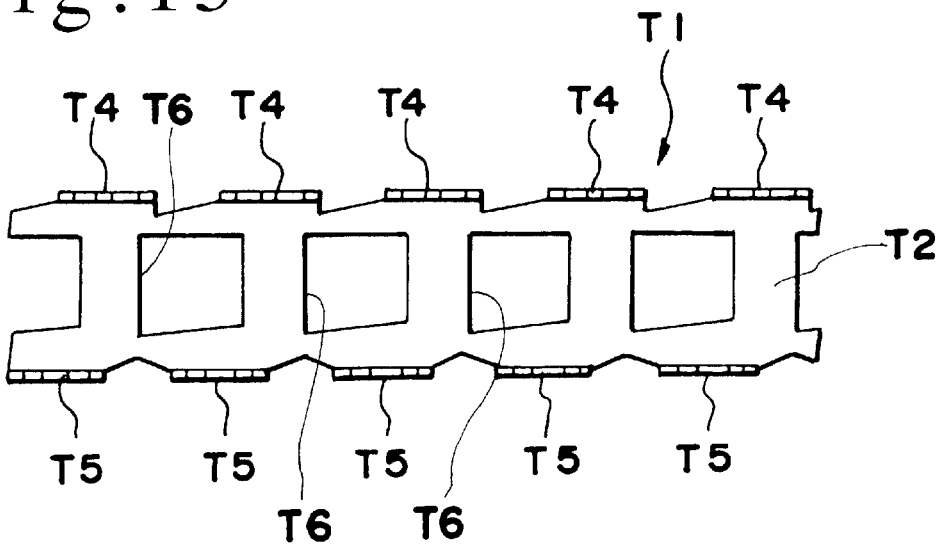
FIG. 15 is a side view of the conventional blind rivet holder.
Figure 14:
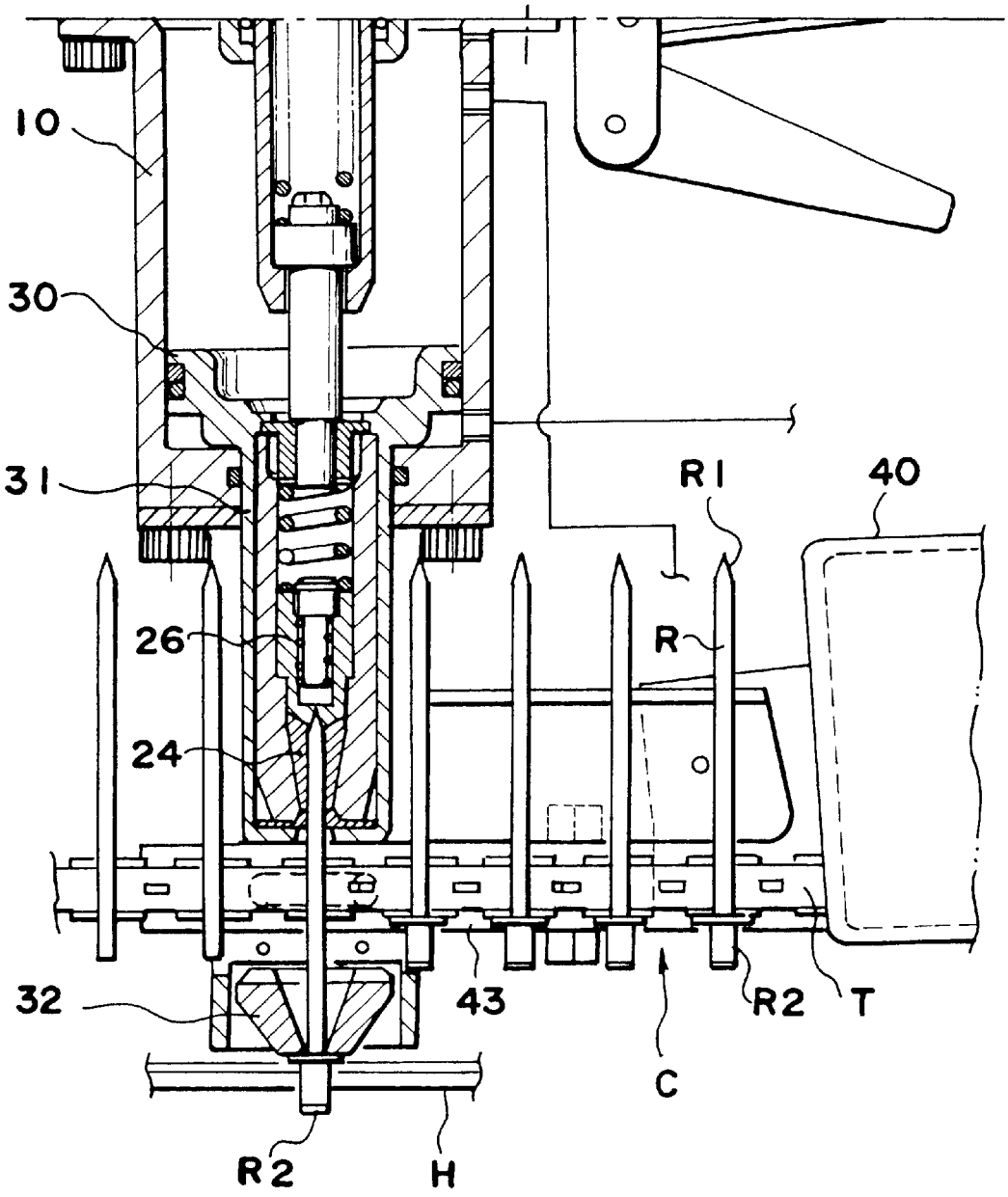
FIG. 14 is another sectional view of the conventional continuous riveter.
Figure 16:
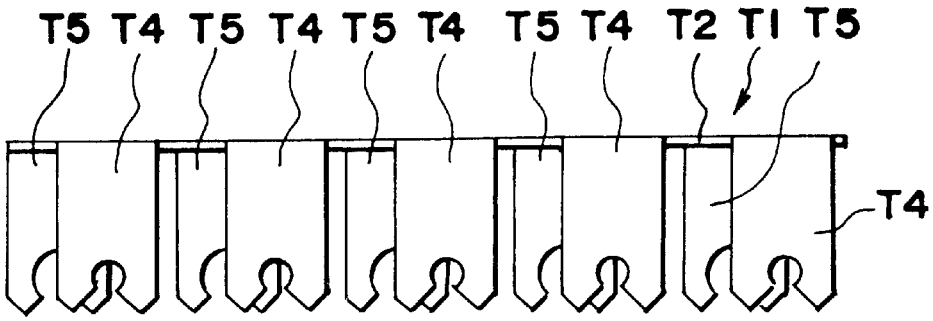
FIG. 16 is a plan view of the conventional blind rivet holder.
Figure 17:
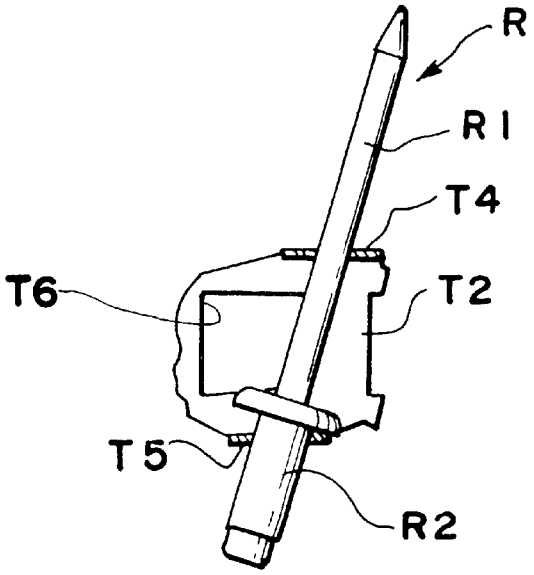
FIG. 17 is a sectional view of a rivet insertion section in the conventional blind rivet holder.

FIGS. 5 to 7 show the steps of use in the guide plate 43 portion. First, from the situation shown in FIG. 5, one blind rivet holder T is sent out as shown in FIG. 6 by the feeding claw 46*a*. Then, the blind rivet holder T enters under the pressing plate 41 to move, so that it bends along the bent section 43*b* of the guide plate 43. At this time, the tip end 41*a* of the pressing plate 41 is widened open in a taper form, so that the perpendicular section T2 of the blind rivet holder T is always entered and guided under the pressing plate 41. Then, as shown in FIG. 6, the shank R1 of the rivet R immediately after it has been bent is disposed to correspond to the axis of the cylinder 31 of the nose piston 30.

Then, the continuous riveter is operated and "caulking" is conducted. At this time, since the blind rivet holder T is bent, a distance L can be defined between the upper and lower tabs T4 and T5 on the bent section 43*b* which has passed the linear feed section 43*a* and immediately after they have been bent as shown in FIG. 1, and the upper and lower tabs T4 and T5 on the linear feed section 43*a* immediately before they have been bent. Consequently, as shown in FIG. 7, the lowering cylinder 31 is free from the abutment with the upper and lower tabs T4 and T5 immediately before they have been bent, and thus the distance between the rivets R can be set as small as possible as shown in FIG. 1. Further, since the upper and lower tabs T4 and T5 on the bent section 43*b* do not have any rivets R since the rivets R have been consumed, they do not hinder the lowering movement of the cylinder 31.

In this embodiment, as shown in FIG. 3, the positions of the upper tab T4 and the lower tab T5 of the blind rivet holder T are shifted, and the rivet R is not made perpendicular with respect to the longitudinal direction of the blind rivet holder T but is inclined at an angle α. Note that the perpendicular arrangement as shown in FIGS. 8 to 14 may be employed in place of this inclined arrangement.

The present invention as described above in detail has the following advantages:

(1) The continuous riveter constructed according to the present invention can make the rivet distance (pitch) in the blind rivet holder small, so that a larger number of the rivets can be accommodated within the accommodation case in comparison with the conventional riveter. Therefore, the number of times in which the blind rivet holder is replaced with a new one at the working site can be reduced, thereby improving the working efficiency.

(2) Since the shorter blind rivet holder (elongated plastic member) can hold the same number of rivets, the cost can be decreased.

(3) The bent section of the guide plate is provided with pressing plates for pressing and guiding the perpendicular section of the blind rivet holder. Therefore, the blind rivet holder sent out linearly is certainly bent along the bent section of the guide plate, and the interval between the upper and lower tabs is certainly widened.

What is claimed is:

1. A continuous riveter comprising:

a chuck cylinder;

a nose piston inserted to the chuck cylinder so as to be movable vertically, and provided at its lower end with an elongated cylinder;

a jaw case piston to which a jaw case is fixed, the jaw case moving vertically within the chuck cylinder;

a jaw, internally inserted to a lower end of the jaw case and engageable and disengageable with and from a tapered surface on an internal lower end of the jaw case, for holding and releasing a shank of a blind rivet;

a jaw pusher elastically biased to abut against a top of the jaw;

a nose piece disposed at a lower end of the elongated cylinder, and to which the shank of the blind rivet is to be inserted; and a rivet supply section including:

an accommodation case for accommodating therein a web-like blind rivet holder in a wound state, the blind rivet being attached to the blind rivet holder; and a tape air cylinder for supplying the blind rivet attached to the blind rivet holder along a guide plate one by one, wherein the guide plate is elongated from the accommodation case of the rivet supply section, and includes a linear feed section of a predetermined length and a bent section inclined at a predetermined angle with respect to the linear feed section, whereby a perpendicular section of the blind rivet holder is bent along the bent section, after being passed through the linear feed section of a predetermined length there along, a pressing plate is provided, for pressing and guiding the perpendicular section of the blind rivet holder, along the guide face from the linear feed section to the bent section of the guide plate, whereby the blind rivet holder sent out linearly by a feeding claw that reciprocatingly linearly moves by means of the tape air cylinder, is guided from the linear feed section to the bent section, and is then bent there along due to the pressing plate, and wherein the cylinder of the nose piston is disposed on a shank of a blind rivet held by an upper tab and a lower tab of the blind rivet holder immediately after the blind rivet holder has been passed through the linear feed section of the guide plate and has been bent at the bent section, so that the axis of the shank of the blind rivet coincides with the axis of the cylinder.

2. A continuous riveter according to claim 1, wherein:

the linear feed section and the bent section are connected to each other at a connection;

a line extending from the connection and perpendicular to the linear feed section defines a first side in which the linear feed section is located, and a second side, opposite from the first side with respect to the line, in which the bent section is located; and the cylinder is located in the second side.

3. A continuous riveter according to claim 1, wherein:

the linear feed section and the bent section are connected to each other at a connection; and the bent section in corporation cooperation with the linear feed section enlarge a distance between rivets, which are located adjacent to the connection and opposite from each other with respect to the connection, to be larger than a pitch between adjacent rivets both located on the linear feed section.

4. A continuous riveter according to claim 1, wherein an axis of the cylinder is offset from an imaginary line connecting shanks of rivets located on the linear feed section.

5. The continuous riveter in accordance with claim 1, wherein:

said tape air cylinder includes a feeding claw moving linearly and reciprocately to linearly move the web-like blind rivet holder.

6. A rivet supply section in combination with a main cylinder, a nose piston movable reciprocally in the main cylinder, the nose piston having an end with an elongated cylinder, a jaw case piston to which a jaw case is fixed, the jaw case moving within the main cylinder, a jaw in an end of the jaw case and engageable and disengageable with a tapered surface on an internal lower end of the jaw case for holding and releasing a shank of a blind rivet, a jaw pusher elastically biased to abut against a top of the jaw and a nose piece disposed at a lower end of the elongated cylinder, and to which the shank of the blind rivet is to be inserted, the rivet supply section comprising:

an accommodation case for accommodating therein a web-like blind rivet holder in a wound state, the blind rivet holder having a plurality of first tabs and second tabs and a perpendicular web joining the first tabs and the second tabs, each blind rivet being attached to the first and second tab of the blind rivet holder;

a tape air cylinder for feeding the blind rivet holder along a guide plate with the blind rivets attached thereto, the blind rivets being periodically fed one by one;

an elongated guide plate extending from the accommodation case of the rivet supply to a location beyond an operation location, the guide plate including a linear feed section of a predetermined length and a bent section inclined at a predetermined angle with respect to the linear feed section;

a pressing plate extending spaced from the guide plate with a guide face from the linear feed section to the bent section of the guide plate, the pressing plate having a bend spaced from and corresponding to a transition from the linear feed section to the bent section of the guide plate;

a single opening in the guide plate and in the pressing plate for a single feeding claw;

a single feeding claw reciprocatingly linearly moving along the single opening by means of the tape air cylinder, the single feeding claw engaging the blind rivet holder and being guided from the linear feed section to the bent section for moving the blind rivet holder with the action of the movement causing the pressing plate, with bend, and opposed transition from the linear feed section to the bent section of the guide plate, to bend the perpendicular section and to periodically stop movement of the blind rivet holder to maintain one set of first and second tabs holding a rivet at the linear feed section of the guide plate with an adjacent set of first and second tabs holding a blind rivet at the operation location along the bent section of the guide plate, wherein the cylinder of the nose piston is disposed for action in the operation location with the position of the blind rivet at the operation location coincides with an axis of the nose piston.

7. A rivet supply section in combination with a blind rivet driving device, the driving device having a operation stroke extending into an operation location, the operation stroke having an operation stroke axis, the rivet supply section comprising:

an accommodation case for accommodating therein a web-like blind rivet holder in a wound state, the blind rivet holder having a plurality of first tabs and second tabs and a perpendicular web joining the first tabs and the second tabs, the first an second tabs being offset to arrange each rivet at an angle for a high density arrangement each blind rivet being attached to the first and second tab of the blind rivet holder;

a tape air cylinder for feeding the blind rivet holder along a guide plate with the blind rivets attached thereto, the blind rivets being periodically fed one by one;

an elongated guide plate extending from the accommodation case of the rivet supply to a location beyond the operation location, the guide plate including a linear feed section of a predetermined length and a bent section inclined at a predetermined angle with respect to the linear feed section;

a pressing plate extending spaced from the guide plate with a guide face from the linear feed section to the bent section of the guide plate, the pressing plate having a bend spaced from and corresponding to a transition from the linear feed section to the bent section of the guide plate;

a single opening in the guide plate and in the pressing plate for accommodating only a single feeding claw;

a single feeding claw reciprocatingly linearly moving along the single opening by means of the tape air cylinder, the single feed claw engaging the blind rivet holder and being guided from the linear feed section to the bent section for moving the blind rivet holder with the action of the movement causing the pressing plate with bend and an angled opposed transition from the linear feed section to the bent section of the guide plate to bend the perpendicular section between adjacent first tabs and adjacent second tabs and to periodically stop movement of the blind rivet holder to maintain one set of first and second tabs holding a rivet at the linear feed section of the guide plate with an adjacent set of first and second tabs holding a blind rivet at the operation location along the bent section of the guide plate, wherein the position of a central axis of the blind rivet at the operation location substantially coincides with the operation stroke axis.

* * * * *